US007776811B2

(12) United States Patent
Dilley et al.

(10) Patent No.: US 7,776,811 B2
(45) Date of Patent: Aug. 17, 2010

(54) CLEANER COMPOSITION, ARTICLE AND METHOD

(75) Inventors: Colin M. Dilley, Thomaston, CT (US); David L. Balog, Naugatuck, CT (US)

(73) Assignee: Honeywell International Inc., Morristown, NJ (US)

( * ) Notice: Subject to any disclaimer, the term of this patent is extended or adjusted under 35 U.S.C. 154(b) by 986 days.

(21) Appl. No.: 11/492,192

(22) Filed: Jul. 24, 2006

(65) Prior Publication Data

US 2007/0021316 A1 Jan. 25, 2007

Related U.S. Application Data

(60) Provisional application No. 60/701,899, filed on Jul. 22, 2005.

(51) Int. Cl.

| | |
|---|---|
| ***C11D 3/02*** | (2006.01) |
| ***C11D 3/48*** | (2006.01) |
| ***C11D 3/00*** | (2006.01) |
| ***C11D 9/50*** | (2006.01) |
| ***C11D 17/00*** | (2006.01) |
| ***C11D 17/08*** | (2006.01) |
| ***B08B 3/14*** | (2006.01) |

(52) U.S. Cl. ..... 510/384; 510/108; 510/278; 510/279; 510/319; 510/329; 510/330; 510/382; 510/383; 510/391; 510/406; 510/504; 8/137; 134/42

(58) Field of Classification Search ..... 510/384, 510/108, 278, 279, 319, 329, 330, 382, 383, 510/391, 406, 504; 8/137; 134/42
See application file for complete search history.

(56) References Cited

U.S. PATENT DOCUMENTS

| | | | | | |
|---|---|---|---|---|---|
| 3,719,613 | A | * | 3/1973 | Marumo et al. | 510/427 |
| 3,850,853 | A | * | 11/1974 | Marumo et al. | 510/427 |
| 3,888,797 | A | * | 6/1975 | Marumo | 510/480 |
| 5,009,887 | A | * | 4/1991 | Iwahashi | 424/470 |
| 5,997,759 | A | | 12/1999 | Trinh et al. | |
| 6,020,303 | A | * | 2/2000 | Cripe et al. | 510/503 |
| 6,046,150 | A | * | 4/2000 | Choy et al. | 510/376 |
| 6,730,648 | B2 | * | 5/2004 | Gorlin et al. | 510/295 |
| 2005/0000390 | A1 | | 1/2005 | Nieendick et al. | |

FOREIGN PATENT DOCUMENTS

| | | | |
|---|---|---|---|
| EP | 0363545 | | 4/1990 |
| PL | 151473 | * | 9/1999 |

OTHER PUBLICATIONS

International Search Report for PCT/US2006/028661, International Filing Date Jul. 24, 2006, dated Nov. 23, 2006.
Written Opinion of the International Searching Authority for PCT/US2006/028661, International Filing Date Jul. 24, 2006, dated Nov. 23, 2006.

* cited by examiner

*Primary Examiner*—Lorna M Douyon
*Assistant Examiner*—Tanisha Diggs
(74) *Attorney, Agent, or Firm*—Cantor Colburn LLP

(57) ABSTRACT

A cleaner composition comprises a surfactant, a sodium source, an odor neutralizer, a fragrance, and a biocide, wherein the odor neutralizer comprises a betaine compound, aminoalcohol, a polyol, and an ionone, and wherein the cleaner composition is stable at a pH of about 9.5 to about 11.5 when stored for 24 months at a temperature of about 25° C. A spray dispenser comprises the cleaner composition and a propellant. Also described is a method of cleaning, deodorizing, or a combination thereof, automobile interiors by applying the disclosed cleaner composition to an automobile interior.

22 Claims, No Drawings

CLEANER COMPOSITION, ARTICLE AND METHOD

CROSS REFERENCE TO RELATED APPLICATIONS

This application claims the benefit of U.S. Provisional application Ser. No. 60/701,899, filed Jul. 22, 2005, the contents of which are incorporated herein by reference thereto.

BACKGROUND

Many different cleaning compositions have been developed for a variety of purposes. Cleaners may include action to remove grease and/or particulate soil, to deodorize, to disinfect (killing both bacterial and viral micro-organisms), to remove stains, to remove mildew, to bleach, and to preserve color of the material being cleaned. Typical fabric cleaning methods may remove or mask odors from fabric containing relatively low levels of malodors. However, when the fabric has relatively high levels of malodorants, or when the fabric contains certain malodors such as those from pet soils, incontinent odors, regurgitated food, general food spills, mold, or mildew, there may be a lingering malodor that is not removed or masked by typical fabric cleaning methods. In such cases where malodor persists after a typical fabric cleaning process, consumers may clean the malodor-containing area of carpet a second, or even a third time. This creates excessive wear on the fabric, especially in the specific area containing the malodor, and can result in an uneven appearance in the fabric due to uneven wear and tear.

Cyclodextrin has been used to control odors in deodorizer and cleaner compositions. Cyclodextrin, however, may interact with perfumes and surfactants when incorporated in detergent compositions, and the level required for malodor control is very high. Odor blockers are used in other compositions. Some odor blockers, when used at the high levels needed for malodor control, may block the desirable odors of perfumes as well as the malodors. Similarly, some masking compounds block desirable odors while reactants can destroy desirable odors.

There thus remains a need for new cleaner and deodorizer compositions, particularly those suitable for fabrics.

SUMMARY

In one embodiment, a cleaner composition comprises an odor neutralizer wherein the odor neutralizer comprises a betaine compound, an aminoalcohol, a polyol, and an ionone.

In one exemplary embodiment, a cleaner composition comprises a surfactant, a sodium source, an odor neutralizer, a fragrance, and a biocide, wherein the odor neutralizer comprises a betaine compound, an aminoalcohol, a polyol, and an ionone; and wherein the cleaner composition is stable at a pH of about 9.5 to about 11.5 when stored for 24 months at a temperature of about 25° C.

In another embodiment, a spray dispenser comprising the foregoing cleaner composition and optionally a propellant is described.

In yet another embodiment, a method of cleaning, deodorizing, or a combination thereof, automobile interiors comprises applying the foregoing cleaner composition to an automobile interior.

The above-described and other features will be appreciated and understood by those skilled in the art from the following detailed description, and appended claims.

DETAILED DESCRIPTION

The term "contaminant(s)" describes most substances that are not normally found in fabrics in their clean or uncontaminated state and are generally removed from fabrics during cleaning processes. Illustrative contaminants include fats, fatty acids such as triglycerides, fat-like substances, salts, food remnants (e.g., coffee, soda, ketchup, mustard, chocolate and milk), sweat, blood, urine, smoke, stains, soil, oil and grease and numerous other synthetic and natural or biological contaminants which are not normally found in clean textiles. Some common contaminants include urine, sour milk and smoke.

The terms "textile(s)" and "fabric(s)" are used to describe cloth and related materials comprised of natural and synthetic fibers which are used to make garments, clothing, carpeting, cloth coverings and related cloth-containing items. Textiles which are compatible for use with the present compositions include textiles made from natural and synthetic fibers and yarns, such as, for example, silks, cottons, wool, kapok, linen, hemp, jute, manila, alfa, coconut, broom, kenaf, ramie, sisal, polyesters, acetates, triacetates, rayon, rayon-acetates, cellulose, polypropylene-cellulose, polyolefins, alginates, cupro (regenerated cellulose), modal, regenerated protein fiber, polyacryl, polychloride, fluorofiber, modacryl, polyacrylonitrile, polyamide (including nylon), polyethylene, polypropylene, polyurea, polyurethane, vinylal, trivinyl, elastodienes, elasthane, and mixtures of these natural and synthetic fibers, among others.

The inventors herein have discovered a cleaner composition that also has odor neutralization properties due to synergistic interactions between the various components. In one exemplary embodiment, the cleaner composition comprises a surfactant, a sodium source, an odor neutralizer, a fragrance, and a biocide, wherein the odor neutralizer comprises a betaine compound, an aminoalcohol, a polyol, and an ionone, wherein the cleaner composition is stable at a pH of about 9.5 to about 11.5 when stored for 24 months at a temperature of about 25° C.

As used herein, the term stable means that the composition is shelf-stable, that is, exhibits substantially no precipitate formation, phase separation, or chemical degradation such as hydrolytic cleavage. For example, in a stable formulation there will be no substantial change in the appearance of the formulation.

In one exemplary embodiment, the cleaner composition comprises a surfactant. The surfactant may comprise a nonionic surfactant, an anionic surfactant, a cationic surfactant, an amphoteric surfactant, or a combination comprising one or more of the foregoing surfactants. Without being held to theory, it is believed that the surfactant emulsifies odiferous materials such as, for example, oils, dirt, foodstuffs, pet odors, urine, vomit, and the like. Emulsification can increase the surface area for odor neutralization and/or create an environment for odor neutralization.

Suitable nonionic surfactants include, but are not limited to, ethoxylated alcohols, ethoxylated phenols, ethoxylated fatty acid esters, ethoxylated glycerol fatty acid esters, sorbitan fatty acid esters, glycerol fatty acid esters, coconut monoethanolamide ethoxylates, ethoxylated tall oil, ethoxylated polypropylene glycol, fatty acid alkanolamides such as coconut mono- and diethanolamide, amine oxides, n-alkyl pyrrolidones, alkyl polysaccharides such as sucrose esters and alkyl polyglycosides, alkyl phenol ethoxylates, ethoxylated castor oil, fatty acid ethoxylates, fatty amine ethoxylates, polyglycerol fatty acid esters, and alkyl adducts of ethylene-oxide-propylene oxide copolymers, as well as mixtures of two or more of the foregoing. In one embodiment, the nonionic surfactant comprises an ethoxylated alcohol such as Tomadol® 25-7, a $C_{12}$-$C_{15}$ ethoxylated alcohol available from Tomah Products, Inc. In another embodiment, the surfactant comprises an alkyl polyglycoside such as Glucopon® 425, believed to be a mixture of D-glucopyranoside or a similar $C_{10}$-$C_{16}$ alkyl oligomer and D-glucose, or Glucopon® 215, believed to comprise D-glucopyranoside or a similar $C_{10}$-$C_{16}$ alkyl oligomer, both available from Cognis. In another embodiment, the surfactant comprises an alkyl polyglycoside such as Dehypound WO7 available from Cognis, believed to comprise a mixture comprising a $C_{10}$-$C_{16}$ alkyl polyglycoside and a $C_8$-$C_{10}$ alcohol ethyoxylate propoxylate plus decene epoxide. In another embodiment, the surfactant comprises an alkyl polyglycoside such as Dehypound HSC 5515 available from Cognis, believed to comprise a mixture comprising a $C_{10}$-$C_{16}$ alkyl polyglycoside, and reaction products of epichlorohydrin and isodecyl alcohol-4EO. In yet another embodiment, the nonionic surfactant comprises Genapol® EP 1024 (formerly known as Sandoxylate® SX-408), an iso-$C_{10}$-ethylene oxide-propylene oxide copolymer adduct. Another suitable nonionic surfactant is an ethoxylated nonylphenol available as a mixture with another proprietary surfactant as Monamulse DLE, available from Uniqema.

Suitable anionic surfactants include, but are not limited to, linear and/or branched chain alkylbenzene sulfonates, alkyl sulfates, ether sulfates, secondary alkyl sulfates, α-olefin sulfonates, phosphate esters, sulfosuccinates, isethionates, carboxylates, and combinations comprising one or more of the foregoing anionic surfactants. Specific anionic surfactants include, for example, sodium lauryl sulfate, sodium lauryl ether sulfate, triethanolamine lauryl sulfate, magnesium lauryl sulfate, sulfosuccinate esters, ammonium lauryl sulfate, alkyl sulfonates, sodium lauryl sulfate, sodium alpha olefin sulfonates, alkyl sulfates, sulfated alcohol ethoxylates, sulfated alkyl phenol ethoxylates, sodium xylene sulfonate, alkylbenzene sulfonates such as triethanolamine dodecylbenzene sulfonate, sodium dodecylbenzene sulfonate, calcium dodecylbenzene sulfonate, xylene sulfonic acid, dodecylbenzene sulfonic acid, N-alkoyl sarcosinates such as sodium lauroyl sarcosinate, dialkylsulfosuccinates, N-alkoyl sarcosines such as lauroyl sarcosine, alkyl ether carboxylates, soaps including sodium, potassium, magnesium, calcium, alkanolamine, and amine soaps, and combinations comprising one or more of the foregoing anionic surfactants. In one embodiment, the anionic surfactant is sodium lauryl sulfate available as WITCOLATE® WAC LA from Akzo.

Amphoteric surfactants include, but are not limited to, betaines, n-alkyl pyrrolidones, imidazolines, and combinations comprising one or more of the foregoing surfactants.

Cationic surfactants include, but are not limited to, quaternary ammonium compounds including alkyl dimethyl benzyl ammonium chloride, dialkyl dimethyl ammonium chloride, alkyl trimethyl ammonium chloride or bromide, salts of organic or inorganic acids with fatty amines, fatty amine ethoxylates, and combinations comprising one or more of the foregoing cationic surfactants.

Mixtures of surfactant types may be used, such as a mixture of a nonionic and an anionic surfactant. A proprietary mixture of this type is Monamulse® DLE available from Mona Industries, Inc.

In one embodiment, the surfactant comprises an alkyl adduct of an ethylene-oxide-propylene oxide copolymer, an alkyl polyglycoside, sodium lauryl sulfate, and an ethoxylated alcohol. In one embodiment, the alkyl polyglycoside comprises an alkyl polyglycoside having an alkyl chain length of from $C_8$-$C_{16}$. An illustrative example of a suitable commercially available surfactant comprising a suitable alkyl polyglycoside having an alkyl chain length of from $C_8$-$C_{16}$ is Dehypound HSC 5515 from Cognis. In another embodiment, the alkyl polyglycoside comprises an alkyl polyglycoside having an alkyl chain length of from $C_8$-$C_{10}$. An example of a commercially available surfactant comprising a suitable alkyl polyglycoside having an alkyl chain length of from $C_8$-$C_{10}$ is Dehypound WO7 from Cognis.

In one embodiment, the surfactant comprises 0.0 percent by weight (wt %) to about 2 wt % of the cleaner composition, based on the total weight of the cleaner composition. In another embodiment, the surfactant will comprise from about 0.2 percent by weight to about 1.0 percent by weight. In one exemplary embodiment, the surfactant will comprise about 0.95 weight percent of the cleaner composition.

In the embodiment wherein the surfactant comprises an alkyl adduct of an ethylene-oxide-propylene oxide copolymer, an alkyl polyglycoside, sodium lauryl sulfate, and an ethoxylated alcohol, the ethylene-oxide-propylene oxide copolymer comprises about 0.1 wt % to about 0.3 wt % of the cleaner composition, the alkyl polyglycoside comprises about 0.05 wt % to about 0.5 wt % of the cleaner composition, the sodium lauryl sulfate comprises about 0.125 wt % to about 0.625 wt % of the cleaner composition, and the ethoxylated alcohol comprises about 0.05 wt % to about 0.3 wt % of the cleaner composition, based on the total weight of the cleaner composition.

In one exemplary embodiment, the cleaner composition comprises a sodium source. Without being held to theory, it is believed that the sodium of the sodium source interacts with odiferous molecules, replacing, for example, sulfur and/or organic groups, to produce a less odiferous or non-odiferous molecule. Suitable sodium sources include, for example, sodium citrate, sodium salts, and sodium lauryl sulfate.

The cleaner composition further comprises an odor neutralizer. Some odor neutralizers mask malodors by reducing the amount of the compounds generating the malodor. As used herein, odor neutralizers are compounds that react with odiferous molecules to reduce or eliminate odor. The odor neutralizer comprises a betaine compound, an aminoalcohol, a polyol, and an ionone. It is believed that the synergistic interaction of the betaine compound, aminoalcohol, polyol, and ionone along with a surfactant, results in neutralization of a wide variety of odors.

The odor neutralizer comprises a betaine compound. Betaine compounds may be effective for deodorization of alkaline odor gases such as ammonia or trimethylamine (TMA) as well as acidic odor gases such as hydrogen sulfide or methylmercaptan (MeSH). Suitable betaine compounds include, for example, glycine betaines such as ethanaminium N-(carboxymethyl)-2-hydroxy-N,N,bis(2-hydroxyethyl) chloride. Compositions containing betaines are available as Epoleon® N-NZ and Epoleon®-100, for example, available from Epoleon Corporation.

The odor neutralizer also comprises an aminoalcohol. Aldehydes such as acetaldehyde, butanal (butylaldehyde), isobutanal, 2-methylbutanal, 3-methylbutanal, hexanal, and the like, can cause foul odors such as urine odors. Aminoalcohols such as, for example, monoethanolamine, diethanolamine, triethanolamine, and combinations comprising one or more of the foregoing aminoalcohols can neutralize aldehyde odors.

The odor neutralizer comprises a polyol which may complex with malodorous components and/or impart a pleasant fragrance to the cleaner composition. Suitable polyols include, for example, ethylene glycol, diethylene glycol, triethylene glycol, propylene glycol, dipropylene glycol, and combinations comprising one or more of the foregoing glycols. In one embodiment, the polyol is triethylene glycol. The triethylene glycol may be added to the formulations in the form of T.O.C. Termiticide Odor Counteractant available from Aire-Mate, Inc.

The odor neutralizer also comprises an ionone. Ionones may have odor masking properties. Suitable ionones include, for example, alpha ionones, beta ionones, gamma ionones, and combinations comprising one or more of the foregoing ionones.

The odor neutralizer comprises about 0.125 wt % to about 0.5 wt % of the cleaner composition, based on the total weight of the cleaner composition. In another embodiment, the odor neutralizer comprises about 0.25 wt % to about 0.5 wt % of the cleaner composition, based on the total weight of the cleaner composition. In yet another embodiment, the odor neutralizer comprises about 0.375 wt % to about 0.5 wt % of the cleaner composition, based on the total weight of the cleaner composition.

In one exemplary embodiment, the cleaner composition comprises a fragrance. Fragrances may modify a malodor to a more pleasant character by superimposing a dominant, but more pleasant odorant. One advantage of fragrances is that they typically have lower boiling points than other substances and so the scents from these materials quickly diffuse into the air, and compete with the malodors to bind to the nasal receptor sites. Because the scents form these fragrances are more volatile and arrive before the malodors at the nasal receptor sites, when the malodors do finally arrive the nasal receptor sites have already been occupied, thus effectively masking the recognition of the malodors.

Suitable fragrances include, for example, anethol, methyl heptine carbonate, ethyl aceto acetate, para cymene, nerol, decyl aldehyde, para cresol, methyl phenyl carbinyl acetate, undecylenic aldehyde, undecyl aldehyde, 2,6-nonadienal, nonyl aldehyde, octyl aldehyde, phenyl acetaldehyde, anisic aldehyde, benzyl acetone, ethyl-2-methyl butyrate, damascenone, damascone alpha, damascone beta, flor acetate, frutene, fructone, herbavert, iso cyclo citral, methyl isobutenyl tetrahydro pyran, isopropyl quinoline, 2,6-nonadien-1-ol, 2-methoxy-3-(2-methylpropyl)-pyrazine, methyl octine carbonate, tridecene-2-nitrile, allyl amyl glycolate, cyclogalbanate, cyclal C, melonal, gamma nonalactone, cis 1,3-oxathiane-2-methyl-4-propyl, benzaldehyde, benzyl acetate, camphor, camphene, carvone, borneol, bornyl acetate, decyl alcohol, eucalyptol, linalool, hexyl acetate, iso-amyl acetate, thymol, carvacrol, limonene, menthol, iso-amyl alcohol, phenyl ethyl alcohol, alpha pinene, a terpineol, citronellol, alpha thujone, benzyl alcohol, beta gamma hexenol, dimethyl benzyl carbinol, phenyl ethyl dimethyl carbinol, adoxal, allyl cyclohexane propionate, beta pinene, citral, citronellyl acetate, citronellal nitrile, dihydro myrcenol, geraniol, geranyl acetate, geranyl nitrile, hydroquinone dimethyl ether, hydroxycitronellal, linalyl acetate, phenyl acetaldehyde dimethyl acetal, phenyl propyl alcohol, prenyl acetate, triplal, tetrahydrolinalool, verdox, cis-3-hexenyl acetate, ethyl methyl phenyl glycidate, ethyl vanillin, heliotropin, indol, methyl anthranilate, vanillin, amyl salicylate, coumarin, ambrox, bacdanol, benzyl salicylate, butyl anthranilate, cetalox, ebanol, cis-3-hexenyl salicylate, lilial, gamma undecalactone, gamma dodecalactone, gamma decalactone, calone, cymal, dihydro iso jasmonate, iso eugenol, lyral, methyl beta naphthyl ketone, beta naphthol methyl ether, para hydroxyl phenyl butanone, 8-cyclohexadecen-1-one, oxocyclohexadecen-2-one/habanolide, florhydral, intreleven aldehyde, amyl cinnamic aldehyde, hexyl cinnamic aldehyde, hexyl salicylate, methyl dihydro jasmonate, sandalore, veloutone, undecavertol, exaltolide/cyclopentadecanolide, zingerone, methyl cedrylone, sandela, dimethyl benzyl carbinyl butyrate, dimethyl benzyl carbinyl isobutyrate, triethyl citrate, cashmeran, phenoxy ethyl isobutyrate, iso eugenol acetate, helional, iso E super, ionone gamma methyl, pentalide, galaxolide, phenoxy ethyl propionate, and combinations comprising one or more of the foregoing fragrances. In one embodiment, the fragrance comprises camphor, camphene, amyl salicylate, terpineol, or a combination comprising one or more of the foregoing fragrances.

In one embodiment, the fragrance comprises 0.0 wt % to about 0.325 wt % based on the total weight of the cleaner composition. In another embodiment, the fragrance comprises about 0.01 wt % to about 0.125 wt % of the cleaner composition, based on the total weight of the cleaner composition. In another embodiment, the fragrance comprises about 0.01 wt % to about 0.25 wt % of the cleaner composition, based on the total weight of the cleaner composition. In yet another embodiment, the fragrance comprises about 0.01 wt % to about 0.325 wt % of the cleaner composition, based on the total weight of the cleaner composition.

In one embodiment, the cleaner composition comprises a biocide. Suitable biocides include, for example, 2-methylthio-4-tert-butylamino-6-cyclopropylamino-s-triazine; 4,4-dimethyl-oxazolidine; 3,4,4-trimethyloxazolidine; 5-hydroxy-methyl-1-aza-3,7-dioxabicylco(3.3.0.)octane; 2-(hydroxymethyl)-aminoethanol; 2-(hydroxymethyl)-amino-2-methyl-1-propanol; hexyhydro-1,3,5-tri-ethyl-5-triazine; 1-(3-chloroallyl)-3,5,7-triaza-1-azonia-adamantane chloride; 1-methyl-3,5,7-triaza-1-azonia-adamantane chloride; p-chloro-m-cresol; an alkylamine hydrochloride; 6-acetoxy-2,4-dimethyl-1,3-dioxane; 5-chloro-2-methyl-4-isothiazolin-3-one; 2-methyl-4-isothiazolin-3-one; 1,3-bis(hydroxymethyl)-5,5-dimethylhydantoin; hydroxymethyl-5,5-dimethylhydantoin; 2-(4-thiazolyl)benzimidazole; N-trichloromethyl-thio-4-cyclohexene-1,2-dicarboximide; 2-n-octyl-4-isothiazoline-3-one; 2,4,5,6-tetrachloro-isophthalonitrile; 3-iodo-2-propynyl butyl carbamate; N-(trichloromethyl-thio)phthalimide; tetrachloroisophthalonitrile; potassium N-hydroxy-methyl-N-methyl-dithiocarbamate; sodium 2-pyridinethiol-1-oxide; butyl parahydroxybenzoate; ethyl parahydroxybenzoate; methyl parahydroxybenzoate; propyl parahydroxybenzoate; 2-mercaptobenzo-thiazole; 5-chloro-2-methyl-3(2H)-isothiazoline; 2-methyl-3(2H)-isothiazolone; 4-(2-nitrobutyl)-morpholine; 4,4'-(2-ethylnitrotrimethylene dimorpholine; tetra-hydro-3,5-di-methyl-2H-1,3,5-thiadiazine-2-thione; potassium dimethyldithiocarbamate; diiodomethyl-p-tolysulfone; glutaraldehyde; methylenebis(thiocyanate); 1,2-dibromo-2,4-dicyanobutane; 1,2-benzisothiazoline-3-one; 2-(thiocyanomethyl-thio)benzothiazole; 2-(thiocyanomethyl-thio) benzothiozole; methylene bis(thiocyanate); and combinations comprising one or more of the foregoing biocides.

In one embodiment, the biocide comprises 0.0 wt % to about 0.3 wt % based on the total weight of the cleaner composition. In another embodiment, the biocide comprises about 0.01 wt % to about 0.3 wt % of the cleaner composition, based on the total weight of the cleaner composition. In another embodiment, the biocide comprises about 0.01 wt % to about 0.15 wt % of the cleaner composition, based on the total weight of the cleaner composition.

The cleaner composition optionally comprises a hydrotrope to aid in suspension of the surfactants. One suitable hydrotrope is DeTrope CA-100, a modified carboxylate available from DeForest Enterprises. DeTrope CA-100 is advantageous because it may also have corrosion inhibition properties.

In one embodiment, the hydrotrope comprises 0.0 wt % to about 0.5 wt % of the cleaner composition, based on the total weight of the cleaner composition. In another embodiment, the hydrotrope comprises about 0.3 wt % to about 0.4 wt % of the cleaner composition, based on the total weight of the cleaner composition. In yet another embodiment, the hydrotrope comprises about 0.3 wt % of the cleaner composition, based on the total weight of the cleaner composition.

The cleaner composition optionally comprises a corrosion inhibitor. Suitable corrosion inhibitors include, for example, triazoles, nitrites (e.g., sodium nitrite), molybdates (e.g., sodium molybdate), benzoates (e.g. 1,2,3-benzotriazole), gluconates, and combinations comprising one or more of the foregoing corrosion inhibitors. In one embodiment, the corrosion inhibitor comprises sodium nitrite.

In one embodiment, the corrosion inhibitor comprises 0.0 wt % to about 0.58 wt % of the cleaner composition, based on the total weight of the cleaner composition. In another embodiment, the corrosion inhibitor comprises about 0.03 wt % to about 0.05 wt % of the corrosion cleaner composition, based on the total weight of the cleaner composition. In another embodiment, the corrosion inhibitor comprises about 0.08 wt % to about 0.03 wt % of the cleaner composition, based on the total weight of the cleaner composition. In yet another embodiment, the corrosion inhibitor comprises about 0.03 wt % to about 0.58 wt % of the cleaner composition, based on the total weight of the cleaner composition.

The cleaner composition optionally comprises a water soluble alkali sodium carbonate salt as a builder. A builder is a compound that lowers the critical micelle concentration (CMC) of surfactants. The term "carbonate" as used herein means a salt that contains either a $CO_3^{2-}$ or a $HCO_3^-$ anion. Carbonate salts can be provided by one or more sodium carbonate salts or sodium bicarbonate. Sodium carbonate salts include, but are not limited to, sodium carbonate per se, sodium carbonate decahydrate, sodium carbonate heptahydrate, sodium carbonate monohydrate, sodium sesquicarbonate and double salts and mixtures thereof. Mixtures of the above mentioned sodium carbonate salts and sodium bicarbonate also are especially useful.

In one embodiment, the sodium carbonate salt comprises 0.0 wt % to about 1.0 wt % of the cleaner composition, based on the total weight of the cleaner composition. In another embodiment, the sodium carbonate salt comprises about 0.05 wt % to about 1.0 wt % of the cleaner composition, based on the total weight of the cleaner composition. In another embodiment, the sodium carbonate salt comprises about 0.05 wt % to about 0.5 wt % of the cleaner composition, based on the total weight of the cleaner composition. In yet another embodiment, the sodium carbonate salt comprises about 0.01 wt % to about 0.05 wt % of the cleaner composition, based on the total weight of the cleaner composition.

The cleaner composition optionally comprises a terpene compound. As used herein, the term "terpene compound" refers to a class of acyclic and cyclic unsaturated compounds derived from natural essential oils and resins having at least 10 carbon atoms. Terpenes include alcohols and aldehydes as well as unsaturated hydrocarbons. A number of terpene compounds, including combinations of these terpenes may be employed. Suitable terpene compounds include, for example, alpha-terpinene, alpha-pinene, beta-pinene, delta-3-carene, citronellal, citronellol, hydroxycitronellal, d-limonene, linalool, gamma-terpinene, tetrahydrolinalool and terpineol, among others. In one embodiment the terpene compound is d-limonene.

The terpene compound comprises 0.0 wt % to about 0.02 wt % of the cleaner composition, based on the total weight of the cleaner composition. In another embodiment, the terpene compound comprises 0.0 wt % to about 2.0 wt % of the cleaner composition, based on the total weight of the cleaner composition.

Colorants and dyes may optionally be added to the cleaner compositions for visual appeal and performance impression. When colorants are used, they may be employed at levels sufficient to color the cleaner composition, but below that which may result in coloration of fabric.

In one embodiment a method of making the disclosed cleaner composition comprises combining a hydrotrope and water to form a first mixture, adding a surfactant to form a second mixture, and adding an odor neutralizer and a fragrance to form the cleaner composition.

The cleaner composition may be stored in a spray dispenser in order to be distributed onto fabric. The spray dispenser may be a manually activated means for producing a spray of liquid droplets as is known in the art, e.g. trigger-type, pump-type, non-aerosol self-pressurized, aerosol-type spray means, and the like. The spray dispenser may include those that will not substantially foam the cleaner composition. The spray dispenser optionally comprises a brush to facilitate soil removal.

The spray dispenser can be an aerosol dispenser. The aerosol dispenser comprises a container which can be constructed of a conventional material employed in fabricating aerosol containers. The dispenser may be capable of withstanding internal pressure of about 20 to about 110 p.s.i.g., or about 20 to about 70 p.s.i.g. A spray dispenser is provided with a valve member which permits the cleaner composition contained in the dispenser to be dispensed in the form of a spray of fine, or finely divided, particles or droplets. The aerosol dispenser utilizes a pressurized sealed container from which the cleaner composition is dispensed through an actuator/valve assembly under pressure. The aerosol dispenser is pressurized by incorporating therein a gaseous component generally known as a propellant. Suitable aerosol propellants include, for example, gaseous hydrocarbons such as isobutane, propane, mixed halogenated hydrocarbons, compressed air, nitrogen, inert gases, carbon dioxide, and the like, and combinations comprising one or more of the foregoing propellants. An exemplary propellant is Aeron NP-46, a mixture of propane and n-butane available from Diversified CPC International.

The spray dispenser can be a self-pressurized non-aerosol container having a convoluted liner and an elastomeric sleeve. The self-pressurized dispenser may comprise a liner/sleeve assembly containing a thin, flexible radially expandable convoluted plastic liner of, for example, about 0.010 to about 0.020 inch thick, inside an essentially cylindrical elastomeric sleeve. The liner/sleeve is capable of holding a substantial quantity of cleaner composition and of causing the product to be dispensed. Another type of aerosol spray dispenser is one wherein a barrier separates the cleaner composition from the propellant (for example, compressed air or nitrogen).

The spray dispenser may be a non-aerosol, manually activated, pump-spray dispenser. The pump-spray dispenser may comprise a container and a pump mechanism which securely screws or snaps onto the container. The container comprises a vessel for containing the cleaner composition to be dispensed. The pump mechanism comprises a pump chamber of substantially fixed volume, having an opening at the inner end thereof. Within the pump chamber is located a pump stem having a piston on the end thereof disposed for reciprocal motion in the pump chamber. The pump stem has a passageway there through with a dispensing outlet at the outer end of the passageway and an axial inlet port located inwardly thereof. The container and the pump mechanism can be constructed of a conventional material employed in fabricating pump-spray dispensers, including, but not limited to: polyethylene; polypropylene; polyethyleneterephthalate; and blends of polyethylene, vinyl acetate, and rubber elastomer.

The spray dispenser may be a manually activated trigger-spray dispenser. The trigger-spray dispenser comprises a container and a trigger both of which can be constructed of a conventional material employed in fabricating trigger-spray dispensers, including, but not limited to: polyethylene; polypropylene; polyacetal; polycarbonate; polyethyleneterephthalate; polyvinyl chloride; polystyrene; and blends of polyethylene, vinyl acetate, and rubber elastomer. Other materials can include stainless steel and glass. The trigger-spray dispenser does not incorporate a propellant gas into the cleaner composition. The trigger-spray dispenser may be one which acts upon a discrete amount of the cleaner composition itself, typically by means of a piston or a collapsing bellows that displaces the composition through a nozzle to create a spray of thin liquid. The trigger-spray dispenser may comprise a pump chamber having either a piston or bellows which is movable through a limited stroke response to the trigger for varying the volume of said pump chamber. This pump chamber or bellows chamber collects and holds the cleaner composition for dispensing. The trigger spray dispenser may have an outlet check valve for blocking communication and flow of fluid through the nozzle and is responsive to the pressure inside the chamber. For the piston type trigger sprayers, as the trigger is compressed, it acts on the fluid in the chamber and the spring, increasing the pressure on the fluid. For the bellows spray dispenser, as the bellows is compressed, the pressure increases on the fluid. The increase in fluid pressure in either trigger spray dispenser acts to open the top outlet check valve. The top valve allows the cleaner composition to be forced through the swirl chamber and out the nozzle to form a discharge pattern. An adjustable nozzle cap can be used to vary the pattern of the fluid dispensed. For the piston spray dispenser, as the trigger is released, the spring acts on the piston to return it to its original position. For the bellows spray dispenser, the bellows acts as the spring to return to its original position. This action causes a vacuum in the chamber. The responding fluid acts to close the outlet valve while opening the inlet valve drawing product up to the chamber from the reservoir.

The cleaner composition can be used by distributing, for example, by placing the cleaner composition into a dispensing means, such as a spray dispenser, and spraying an effective amount onto the desired surface or article. An effective amount as defined herein means an amount sufficient to clean and/or absorb malodor to the point that it is not discernible by the human sense of smell yet not so much as to saturate or create a pool of liquid on the article or surface and so that when dry there is no visual deposit readily discernible. Distribution can be achieved by using a spray device, a roller, a pad, and the like.

The present disclosure encompasses the method of spraying a mist of an effective amount of the cleaner composition onto fabric and/or fabric articles. The fabric and/or fabric articles include, but are not limited to, car interior, e.g., car carpet, fabric car seats, and the like, and combinations comprising one or more of the foregoing articles.

The invention is further illustrated by the following non-limiting examples.

Example 1

Cleaner compositions were formed according to Tables 1 and 2.

TABLE 1

| Inventive Formulation 1 | | |
|---|---|---|
| Component | Tradename/Manufacturer | Amount, wt % |
| Surfactant-alkyl adduct of an ethylene-oxide-propylene oxide copolymer | Genapol ® EP 1024 | 0.8 |
| Surfactant-sodium lauryl sulfate | Wicolate ® WAC LA/Akzo Nobel | 0.30 |
| Surfactant-ethoxylated alcohol | Tomodol ® 25-7/Tomah Products Inc. | 0.10 |
| Surfactant-alkyl polyglycoside | Dehypound HSC 5515/Cognis | 0.10 |
| Odor neutralizer-polyol | Termiticide Odor Counteractant/Aire-Mate Inc. | 0.125 |
| Odor neutralizer-betaine compound, aminoalcohol | Epoleon N-Nz/New Epoleon Corp. | 0.25 |
| Odor neutralizer-ionone | Citrus Fresh Neutralizer/Alpha Aromatics | 0.125 |
| Biocide | Suricide P/Surety Laboratories, Inc. | 0.15 |
| Hydrotrope-complex carboxylic acid | DeTrope CA-100/DeForest Enterprises | 0.4 |
| Sodium carbonate | Sodium Carbonate/Spectrum | 0.5 |
| Propellant | NP-46 propellant/Diversified CPC International | 3.0 |
| Water | | 94.9 |

TABLE 2

| Inventive Formulation 2 | | |
|---|---|---|
| Component | Tradename/Manufacturer | Amount, wt % |
| Surfactant-alkyl adduct of an ethylene-oxide-propylene oxide copolymer | Genapol ® EP 1024 | 0.8 |
| Surfactant-sodium lauryl sulfate | Wicolate ® WAC LA/Akzo Nobel | 0.30 |
| Surfactant-ethoxylated alcohol | Tomodol ® 25-7/Tomah Products Inc. | 0.10 |
| Surfactant-alkyl polyglycoside | Dehypound WO7/Cognis | 0.10 |
| Odor neutralizer-polyol | Termiticide Odor Counteractant/Aire-Mate Inc. | 0.125 |
| Odor neutralizer-betaine compound, aminoalcohol | Epoleon N-Nz/New Epoleon Corp. | 0.25 |
| Odor neutralizer-ionone | Citrus Fresh Neutralizer/Alpha Aromatics | 0.125 |
| Biocide | Suricide P/Surety Laboratories, Inc. | 0.15 |
| Hydrotrope-complex carboxylic acid | DeTrope CA-100/DeForest Enterprises | 0.4 |
| Sodium carbonate | Sodium Carbonate/Spectrum | 0.5 |
| Propellant | NP-46 propellant/Diversified CPC International | 3.0 |
| Water | | 94.9 |

TABLE 3

| Control Formulation | | |
|---|---|---|
| Component | Tradename/Manufacturer | Amount, wt % |
| Surfactant-mixture of nonionic and anionic | Monamulse DLE/Uniqema | 0.8 |
| Surfactant-sodium lauryl sulfate | Wicolate ® WAC LA/Akzo Nobel | 0.23 |
| Surfactant-ethoxylated alcohol | Tomodol ® 25-7/Tomah Products Inc. | 0.01 |
| Surfactant-alkyl polyglycoside | Dehypound HSC 5515/Cognis | 0.10 |
| Odor neutralizer-polyol | Termiticide Odor Counteractant/Aire-Mate Inc. | 0.125 |
| Odor neutralizer-betaine compound, aminoalcohol | Epoleon N-Nz/New Epoleon Corp. | 0.25 |
| Odor neutralizer-ionone | Citrus Fresh Neutralizer/Alpha Aromatics | 0.125 |
| Biocide | Suricide P/Surety Laboratories, Inc. | 0.15 |
| Hydrotrope-complex carboxylic acid | DeTrope CA-100/DeForest Enterprises | 0.3 |
| Corrosion inhibitor-sodium nitrite | Sodium nitrite/Young Chemical | 0.05 |
| Sodium carbonate | Sodium Carbonate/Spectrum | 0.5 |
| Propellant | NP-46 propellant/Diversified CPC International | 3.0 |
| Water | | 94.36 |

To form the cleaner compositions, water and the hydrotrope were mixed to form a first mixture. The surfactants were then added to the first mixture to form a second mixture. The remaining ingredients were then mixed in to form the final cleaner composition. The control formulation given in Table 3 was not shelf stable at a pH of about 9.5 to about 11.5 when stored for 24 months at a temperature of about 25° C.

Example 2

Cleaning-Objective Data

The inventive cleaner/odor neutralizer of example 1 was tested in a cleaner assay and an odor removal assay. Samples of fabric (carpet and head liner) are treated with soils. One trained technician cleans fabric samples (the technician does not know which cleaner formulations are being used), and the cleaning is evaluated by trained raters. The cleaning was done mechanically to eliminate differences in results due to cleaning. The subjective testing was performed by trained raters who ranked preferred cleaning ability. The soils evaluated include coffee, used motor oil, mustard, ketchup, chocolate syrup, grape juice, soda (coke) and milk.

For the cleaner assay, a colorimeter is employed to determine cleaning objectively using diffuse reflection. It is an industry standard test instrument. Stain removal is measured by changes in fabric color due to cleaning. For each stain, the total difference from the color of the original fabric to that measured after the stain is applied, dried, and cleaned is measured. The closer to the original color the better, and safer, the cleaner is. Color is measured on 3 axis, L, A and B, corresponding to blue, yellow and red, based on ASTM D4265.

Results were first checked for homogeneity of variance (HOV), which checks that the variances in the two groups are equal. Unequal variance would suggest possible faults in the evaluation procedure and may make the ANOVA analysis less sound. HOV is not as crucial as other assumptions for the ANOVA, or the t-test, for differences in the population mean, in particular in the case of equal n, and also because the test is not necessarily very robust itself.

Next an ANOVA was performed, looking for difference in the mean, the Tukeys test was applied to the results to indicate where differences in the mean occurred. 2 sample T-tests were also performed to highlight differences where the p value for the ANOVA was close to 0.05.

For the cleaner assays, 2 commercial cleaners were compared to inventive formulation 1:

A. Blue Coral Upholstery and Carpet Cleaner (Blue Coral)

B. Turtle Wax Power Out Interior Cleaner (Turtle Wax)

TABLE 4

DE values for cleaner compositions on a nylon substrate

| Formulation | Used Motor oil | Coffee | Mustard | Ketchup | Chocolate Syrup | Grape juice | Soda (Cola) | Milk |
|---|---|---|---|---|---|---|---|---|
| Example 1 formulation | 1.51 | 0.99 | 6.16 | 1.56 | 2.58 | 3.62 | 1.57 | 2.39 |
| A | 1.75 | 1.30 | 5.20 | 1.15 | 2.29 | 1.14 | 1.5 | 1.03 |
| B | 3.26 | 2.43 | 4.4 | 4.37 | 1.56 | 3.01 | 1.79 | 3.98 |

The majority of stains cleaned with inventive formulation 1 demonstrated improved results over the competitors but some stains showed only parity after cleaning. This type of cleaning performance leads to a wider distribution of results, and therefore does not fit a normal distribution.

TABLE 5

DE values for cleaner compositions on a polyester substrate

| Formulation | Used Motor oil | Coffee | Mustard | Ketchup | Chocolate Syrup | Grape juice | Soda (Cola) | Milk |
|---|---|---|---|---|---|---|---|---|
| Example 1 formulation | 1.86 | 2.26 | 5.55 | 3.19 | 1.24 | 2.96 | 2.52 | 2.27 |
| A | 3.76 | 0.62 | 4.4 | 2.32 | 4.49 | 3.15 | 4.56 | 1.49 |
| B | 3.48 | 1.98 | 1.35 | 1.91 | 4.26 | 0.8 | 2.88 | 1.27 |

The majority of stains cleaned with inventive formulation 1 demonstrated improved results over the competitors but some stains showed only parity after cleaning. This type of cleaning performance leads to a wider distribution of results, and therefore does not fit a normal distribution.

Example 3

Cleaning-Subjective Data-Upholstery

Lab testing was based on the AS-345p carpet cleaning procedure AND was subjective and double blind. An ANOVA (P is the value that determines the confidence limits of the event occurring by chance—the significance level for this statistical analysis is 95%, which is a p value of 0.05 or less) was performed on the results. The MSE (measurement system analysis based on an ANOVA analyzed gauge R & R (repeatability and reproducibility)) determined that the number of distinct categories was 6 and was acceptable for the 7 point Likert scale used.

The objective colorimeter testing was unsuccessful on the upholstery due to the loose weave of the fabric. The calorimeter was influenced by the background behind the fabric, resulting in a large measurement standard deviation. The MSE showed that the test method could not distinguish between samples as the number of distinct categories was 0 (see MSE calorimeter/upholstery).

TABLE 6

Subjective Testing Upholstery

| Stain | Performance | P value |
|---|---|---|
| Chocolate syrup | Example 1 = A = B | p = 0.985 |
| Coffee | Example 1 = A = B | p = 0.863 |
| Milk | Example 1 = A = B | p = 0.302 |
| Motor oil | Example 1 = A = B | p = 0.979 |
| Grape juice | Example 1 = A = B | p = 0.440 |
| Ketchup | Example 1 = A = B | p = 0.462 |
| Mustard | Example 1 = A = B | p = 0.340 |
| Cola | Example 1 = A = B | p = 0.877 |
| All soils | Example 1 = A = B | p = 0.679 |

Thus, in subjective testing of stains on upholstery, the formulation of inventive example 1 was comparable to commercially available cleaners.

Example 4

Cleaning-Subjective Data-Carpet

The test protocol used the calorimeter with supporting data from an in-house subjective lab test using employee raters, based on the original carpet cleaning procedure. The test was double blind. An ANOVA was performed on the results. The MSE determined that the number of distinct categories was 6 and was acceptable for the 7 point Likert scale used. See attached MSE, test procedures, data, and analyzed results.

TABLE 7

Subjective cleaning data-carpet

| Stain | Performance | P value |
|---|---|---|
| Chocolate syrup | Example 1 = A<br>Example 1 > B | p = 0.016 |
| Coffee | Example 1 > A<br>Example 1 = B | p = 0.000 |
| Milk | Example 1 > A<br>Example 1 = B | p = 0.021 |
| Motor oil | Example 1 = A = B | p = 0.416 |
| Grape juice | Example 1 = A = B | p = 0.440 |
| Ketchup | Example 1 = A = B | p = 0.462 |
| Mustard | Example 1 = A = B | p = 0.302 |
| Cola | Example 1 = A<br>Example 1 > B | p = 0.000 |
| All soils | Example 1 = A = B | p = 0.195 |

Thus, in subjective testing of stains on upholstery, the formulation of inventive example 1 was comparable to commercially available cleaners.

Example 5

Odor Removal Data

The test protocol employed was subjective, and was double blind. The material source did not affect the odor removing ability of any of the odor neutralizers. Therefore, samples of both upholstery and carpet were used.

TABLE 8

Initial Odor Removal

| Stain | Performance | P value |
|---|---|---|
| Milk | Example 1 > A > B | p = 0.000 |
| Smoke | Example 1 = A = B | p = 0.778 |
| Overall | Example 1 > A, B | p = 0.000 |

TABLE 9

Long Term Odor Removal

| Stain | Performance | P value |
|---|---|---|
| Milk | Example 1 > A > B | p = 0.000 |
| Smoke | Example 1 = A = B | p = 0.459 |
| Overall | Example 1 = A<br>Example 1 > B | p = 0.000 |

Overall, odor removal performance of the formulation of Example 1 is improved over commercially available cleaners.

All ranges disclosed herein are inclusive and combinable. The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

All cited patents, patent applications, and other references are incorporated herein by reference in their entirety.

What is claimed is:

1. A cleaner composition comprising:

a surfactant, a sodium source, an odor neutralizer, a fragrance, and a biocide, wherein the odor neutralizer comprises a betaine compound, an aminoalcohol, a polyol, and an ionone, wherein the betaine compound comprises (ethanaminium N-(carboxymethyl)-2-hydroxy-N,N,bis(2-hydroxyethyl)chloride), and wherein the cleaner composition is stable at a pH of about 9.5 to about 11.5 when stored for 24 months at a temperature of about 25° C.

2. The cleaner composition of claim 1, wherein the surfactant comprises an alkyl adduct of an ethylene-oxide-propylene oxide copolymer, an alkyl polyglycoside, an alkyl sulfate, and an ethoxylated alcohol.

3. The cleaner composition of claim 2, wherein the alkyl polyglycoside comprises an alkyl carbon chain of at least 8 carbons and no more than 16 carbons.

4. The cleaner composition of claim 2, wherein the alkyl polyglycoside comprises an alkyl carbon chain of at least 8 carbons and no more than 10 carbons.

5. The cleaner composition of claim 1, wherein the fragrance is camphor, camphene, amyl salicylate, a terpineol, or a combination comprising one or more of the foregoing fragrances.

6. The cleaner composition of claim 1, wherein the sodium source is sodium citrate.

7. The cleaner composition of claim 1, wherein the polyol comprises triethylene glycol.

8. The cleaner composition of claim 1, wherein the aminoalcohol comprises diethanolamine.

9. The cleaner composition of claim 1, further comprising a corrosion inhibitor.

10. The cleaner composition of claim 1, further comprising a water soluble alkali sodium carbonate.

11. The cleaner composition of claim 1, further comprising a hydrotrope.

12. The cleaner composition of claim 1, further comprising a builder.

13. A spray dispenser comprising a cleaner composition and optionally a propellant, wherein the cleaner composition comprises:

a surfactant,
a sodium source,
an odor neutralizer,
a fragrance,
and a biocide,
wherein the odor neutralizer comprises a betaine compound, aminoalcohol, a polyol, and an ionone,
wherein the betaine compound comprises (ethanaminium N-(carboxymethyl)-2-hydroxy-N,N,bis(2-hydroxyethyl)chloride), and
wherein the cleaner composition is stable at a pH of about 9.5 to about 11.5 when stored for 24 months at a temperature of about 25° C.

14. The spray dispenser of claim 13, wherein the surfactant comprises an alkyl adduct of an ethylene-oxide-propylene oxide copolymer, an alkyl polyglycoside, an alkyl sulfate, and an ethoxylated alcohol.

15. The spray dispenser of claim 13, wherein the surfactant is an anionic surfactant, a nonionic surfactant, an alkyl sulfate, an ethoxylated alcohol, an alkyl polyglycoside, or a combination comprising one or more of the foregoing surfactants.

16. The spray dispenser of claim 13, wherein the fragrance is camphor, camphene, amyl salicylate, a terpineol, or a combination comprising one or more of the foregoing fragrances.

17. The spray dispenser of claim 13, further comprising a corrosion inhibitor.

18. The spray dispenser of claim 13, further comprising a water soluble alkali sodium carbonate.

19. The spray dispenser of claim 13, further comprising a hydrotrope.

20. A method of cleaning, deodorizing, or a combination thereof, automobile interiors comprising applying a cleaner composition to a soiled automobile interior, wherein the cleaner composition comprises a surfactant,
a sodium source,
an odor neutralizer,
a fragrance,
and a biocide,
wherein the odor neutralizer comprises a betaine compound, aminoalcohol, a polyol, and an ionone,
wherein the betaine compound comprises (ethanaminium N-(carboxymethyl)-2-hydroxy-N,N,bis(2-hydroxyethyl)chloride), and
wherein the cleaner composition is stable at a pH of about 9.5 to about 11.5 when stored for 24 months at a temperature of about 25° C.

21. The method of claim 20, wherein the surfactant comprises an alkyl adduct of an ethylene-oxide-propylene oxide copolymer, an alkyl polyglycoside, sodium lauryl sulfate, and an ethoxylated alcohol.

22. The method of claim 20, wherein the fragrance is camphor, camphene, amyl salicylate, a terpineol, or a combination comprising one or more of the foregoing fragrances.

* * * * *